United States Patent [19]

Melnyk

[11] 4,357,990

[45] Nov. 9, 1982

[54] CRIMPED TUBE JOINT-SHOULDER RIBS

[75] Inventor: William Melnyk, Lathrup Village, Mich.

[73] Assignee: Ex-Cell-O Corporation, Troy, Mich.

[21] Appl. No.: 271,414

[22] Filed: Jun. 8, 1981

[51] Int. Cl.[3] ..... F28F 9/26

[52] U.S. Cl. ..... 165/76; 165/150; 165/151; 165/178; 285/334.5; 285/382

[58] Field of Search ..... 165/76, 150–151, 165/172, 176, 178; 285/332.3, 334.5, 382

[56] References Cited

U.S. PATENT DOCUMENTS 4,172,496 10/1979 Melnyk ..... 165/76

*Primary Examiner*—Sheldon J. Richter

*Attorney, Agent, or Firm*—McGlynn and Milton

[57] ABSTRACT

A solderless crimped joint and method for forming same for a heat exchanger (10) of the type having a heat transfer core (12) including a plurality of fins (14) in parallel stacked relationship for defining heat transfer surfaces and a plurality of fluid-carrying tubes (16, 18) extending transversely through the fins (14) for defining a fluid circuit. The fluid circuit includes at least one solderless tube-to-tube joint wherein a first tube (18) includes an end having an annular outwardly extending shoulder (20) followed by an inwardly tapered open frustroconical portion (22). A second tube (16) forming the joint includes an end having an outwardly flared portion (24) in mating engagement with the frustroconical portion (22) and an inwardly extending flange (26) crimped over the shoulder (20) for forcing the tapered portion (22) into the flared portion (24). The assembly is characterized by including a plurality of raised portions (28) or gullets extending from the shoulder (20) in the direction away from the tapered frustroconical portion (22) and extending outwardly of the first tube (18) whereby the flared portion (24) is crimped into engagement about the raised portions (28) and the first tube (18) without any substantial gathering of material in the crimped flared portion (26).

4 Claims, 4 Drawing Figures

CRIMPED TUBE JOINT-SHOULDER RIBS

TECHNICAL FIELD

This invention relates to a solderless crimped joint and the method for forming same for use in a heat exchanger for connecting the tubes thereof.

BACKGROUND ART

This invention is particularly suitable for use with heat exchanger assemblies of the type having a heat transfer core including a plurality of fins in parallel stacked relationship for defining heat transfer surfaces and a plurality of fluid-carrying tubes extending transversely through the fins for defining a fluid circuit. Heat exchanger assemblies of this type are frequently used in the automotive industry as oil coolers, air heaters, radiators and in air-conditioning systems.

It is necessary to connect various tubes together in assembling such heat exchangers. It has been conventional to join tubes in such an assembly by being fluxed and soldered. The soldering of the joints requires significant heat energy, special handling of the components and the soldering materials and, in addition, frequently produces undesirable fumes. In order to overcome some of the problems associated with soldered joints, applicant developed a solderless joint for joining two tubes together by forming one tube with a frustoconical tapered portion extending to a shoulder and another tube with an outwardly flared portion and inserting the frustoconical portion into the flared portion and crimping or bending the end of the flared portion over the shoulder. Such a joint is disclosed in applicant's U.S. Pat. No. 4,172,496 granted Oct. 30, 1979. That joint has proved to be very effective in heat exchangers having a limited number of rows of tubes so that the crimping operation is accomplished by tools which move radially with respect to the axis of the two tubes being joined together. Such a crimping operation is necessary because the heat exchangers typically include a U-shaped tube or return bend for interconnecting adjacent tubes extending through the heat exchanger core and the crimping tools must pass under and clear the U-shaped return bend. In forming such a joint the lengths of the flared portions are not easily maintained constant and, therefore, to prevent the necessity of sizing the lengths of the flared portions, the flared portions are allowed to gather in being crimped about the shoulder. However, there are heat exchanger assemblies having a multiplicity of rows of tubes which must be interconnected by U-shaped return tubes wherein the crimping operation must be accomplished by crimping tools moving axially of the tubes at the joint and such will not permit the gathering of the material crimped over the shoulder of the joint.

STATEMENT OF INVENTION AND ADVANTAGES

The subject invention relates to a tube joint particularly suitable for connecting first (18) and second (16) tubes of a heat exchanger (10) together. The end of a first tube (18) has an annular outwardly extending shoulder (20) followed by an inwardly tapered frustoconical portion (22) and the end of a second tube (16) has an outwardly flared portion (24) having an internal size for receiving and mating engagement with the frustoconical portion (22) and of a length (26) for extending over the shoulder (20). The invention is characterized by including at least one raised portion (28) extending from the shoulder (20) in the direction away from the tapered portion (22) and outwardly of the first tube (18) so that as the frustoconical tapered portion (22) of the first tube (18) is inserted into the outwardly flared portion (24), the end (26) of the outwardly flared portion (24) is crimped over the shoulder (20) and about the raised portion (28).

Such a joint is very strong, provides an effective seal and the crimping may be accomplished by tools moving longitudinally of the axis of the connection between the two tubes. Further, the joint is one wherein relative rotation between the two tubes is prevented.

FIGURES OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
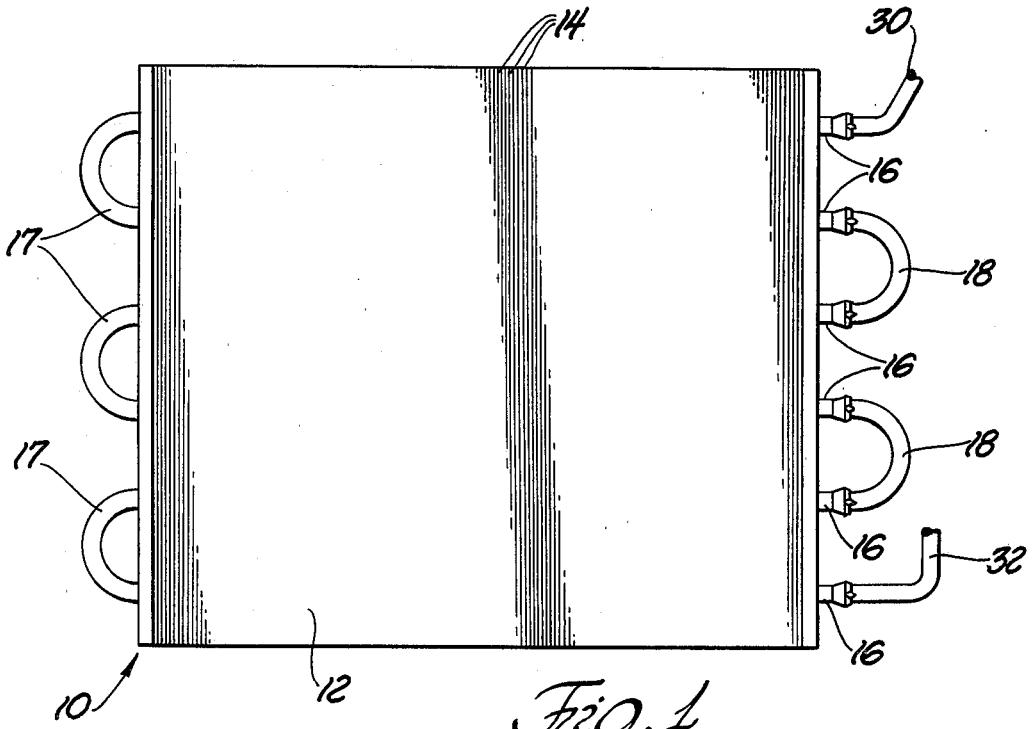
FIG. 1 is a side-elevational view of a heat exchanger assembly employing the tube joint of the subject invention.
Figure 2:
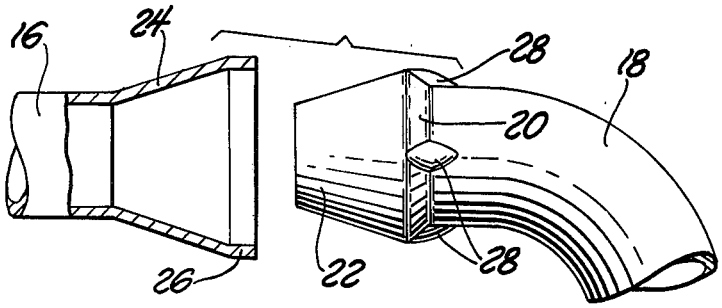
FIG. 2 is a fragmentary partially cross-sectional view showing two tubes employing the joint of the subject invention during assembly thereof.
Figure 4:
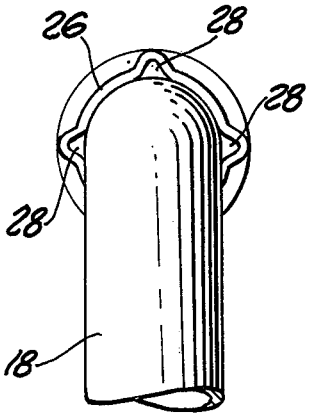
FIG. 4 is a view taken substantially along line 4—4 of FIG. 3.
Figure 3:
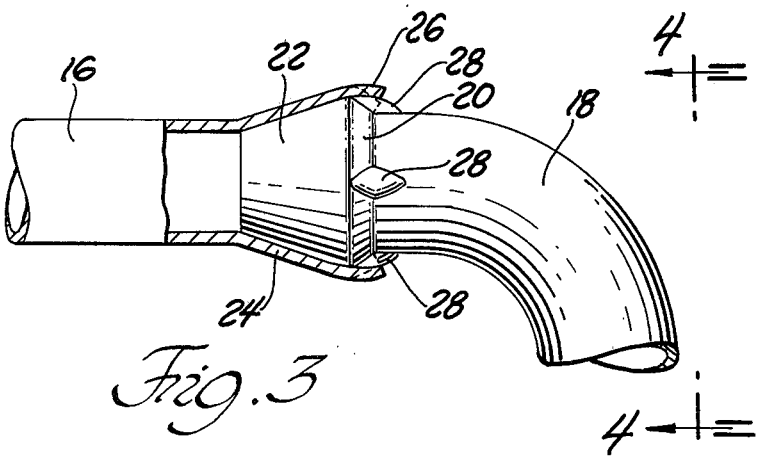
FIG. 3 is a fragmentary partially cross-sectional view showing two tubes joined in accordance with the subject invention.

A heat exchanger assembly constructed in accordance with the instant invention is generally shown at 10 in FIG. 1. The heat exchanger assembly 10 includes a heat transfer core 12 which includes a plurality of heat transfer fins 14 in parallel stacked relationship for defining heat transfer surfaces. A plurality of fluid-carrying tubes 16 and 18 extend through the fins 14 for defining a fluid circuit. The fluid circuit is defined by a length of tube 16 extending through the fins 14, a U-shaped bend 17 and back through an adjacent tube 16. The U-shaped tubes or bends 18 interconnect adjacent tubes 16 through a solderless tube-to-tube joint.

The solderless tube-to-tube joint is defined by a first of the tubes 18 including an end having an annular outwardly extending shoulder 20 followed in a forward direction by an inwardly tapered frustoconical portion 22, the end of the frustoconical portion 22 being open.

A second of the tubes 16 forming the solderless joint includes an end having an outwardly flared portion 24 in mating and sealing engagement with the frustoconical portion 22. In the assembled position the frustoconical portion includes an inwardly extending flange 26 crimped or clenched over the shoulder 20 for forcing the tapered frustoconical portion 22 into the flared portion 24.

The assembly is characterized by including a plurality of raised portions 28 extending from the shoulder 20 in the direction away from the frustoconical portion 22 and radially outwardly of the tube 18. The flared portion 24 is crimped into engagement about each of the raised portions 28 and about the outer surface of the tube 18 between the raised portions 28 so as to be devoid of any substantial gathering of material in the end 26 of the crimped flared portion 24.

Each of the raised portions 28 extends radially outwardly at least as far as the radial extremity of the adjacent shoulder 20. More specifically, in the preferred embodiment the circumferential length about the tube member 18 in a cross section through the raised portions 28 will be at least equal to and preferably slightly greater than the circumferential length of the open end 26 of the flared portion 24. In accordance with that structure, the end 26 of the flared portion 24 would not have sufficient material to gather as it would be taken up by the circumferential length of the raised portions 28 plus the surface of the shoulder and outer surface of the tube 18 between the raised portions 28. Before crimping, the end 26 of the flared portion 24 is in the form of an annular skirt, i.e., the end 26 extends axially of the tube 16 to define a tubular end which is not flared.

Each of the raised portions is defined by a bulbous gullet having a pointed nose joining the shoulder 20 and a pointed nose joining the exterior of the tube 18 whereby each raised portion 28 appears somewhat diamond-shaped in plan view.

In order to insure a pressure-tight seal, the external surfaces of the conical portion 22 and/or the internal surfaces of the flared portion 24 may be coated with an adhesive which acts as a sealant.

The assembly 10 may include an inlet 30 and an outlet 32, both of which may be connected through the solderless joint of the subject invention.

The invention, therefore, includes a method of connecting first and second tubes together by forming an end of the first tube 18 with an annularly outwardly extending shoulder 20 followed by an inwardly tapered frustoconical portion 22 and forming an end of a second tube 16 with an outwardly flared portion 24 having an internal size for receiving and mating engagement with the frustoconical portion 22, the length of the flared portion 24 longitudinally of the tube being sufficient for extending over the shoulder 20 when the flared portion 24 is in mating engagement with the frustoconical portion 22. The method is characterized by forming the raised portions 28 so as to extend from the shoulder 20 in the direction away from the tapered portion 22 and outwardly of the tube 18 and thereafter inserting the tapered portion 22 into the flared portion 24 and crimping the end of the flared portion 24 over the shoulder 20 and also about the raised portions 28. The raised portions are formed to extend radially outwardly a sufficient distance to prevent any gathering of the material in the flared portion 24 while it is being crimped over the shoulder 20 and the raised portions 28.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

I claim:

1. A heat exchanger assembly (10) including a heat transfer core (12) including a plurality of heat transfer fins (14) and a plurality of fluid carrying tubes (16, 18) extending through said fins (14) for defining a fluid circuit and connected together by at least one solderless tube-to-tube joint wherein a first of said tubes (18) includes an end having an annular outwardly extending shoulder (20) followed by an inwardly tapered frustoconical portion (22) and a second of said tubes (16) forming said joint includes an end having an outwardly flared portion (24) in mating engagement with said frustoconical portion (22) and an inwardly extending flange (26) crimped over said shoulder (20) for forcing said tapered frustoconical portion (22) into said flared portion (24), said assembly characterized by at least one raised potion (28) extending from said shoulder (20) in the direction away from said frustoconical portion (22) and outwardly of said first tube (18), said raised portion (28) being a bulbous gullet having a pointed nose joining said shoulder (20) and a pointed nose joining the exterior of said first tube (18).

2. An assembly as set forth in claim 1 further characterized by including a plurality of said raised portions (28) with said flared portion (24) crimped into engagement about said raised portions (28) and said first tube (18) while being void of any substantial gathering of material in said crimped flared portion (24).

3. An assembly as set forth in claim 1 further characterized by including a plurality of said raised portions (28) with each of said raised portions (28) extending radially outwardly at least as far as the radial extremity of said shoulder (20).

4. An assembly as set forth in claim 1 further characterized by the circumferential length about said first tube (18) in a cross section through said raised portion (28) being at least equal to the circumferential length of the open end of said flared portion (24).

* * * * *